US008925137B1

(12) United States Patent
Munoz

(10) Patent No.: US 8,925,137 B1
(45) Date of Patent: Jan. 6, 2015

(54) HYGIENIC WIPING DEVICE

(71) Applicant: Samuel Munoz, Chicago, IL (US)

(72) Inventor: Samuel Munoz, Chicago, IL (US)

( * ) Notice: Subject to any disclaimer, the term of this patent is extended or adjusted under 35 U.S.C. 154(b) by 0 days.

(21) Appl. No.: 14/060,770

(22) Filed: Oct. 23, 2013

(51) Int. Cl.
*A47K 7/08* (2006.01)

(52) U.S. Cl.
CPC ..... *A47K 7/08* (2013.01)
USPC ..... 15/210.1; 15/143.1

(58) Field of Classification Search
USPC ..... 15/104.94, 210.1, 143.1; D24/119
See application file for complete search history.

(56) References Cited

U.S. PATENT DOCUMENTS

| | | | | |
|---|---|---|---|---|
| 2,825,084 | A * | 3/1958 | Sanborn | 15/210.1 |
| D186,157 | S * | 9/1959 | Whamond | D32/51 |
| 2,998,614 | A * | 9/1961 | Winch | 15/210.1 |
| 5,044,040 | A | 9/1991 | Tetrault | |
| 6,158,077 | A * | 12/2000 | Wenger et al. | 15/210.1 |
| D439,977 | S * | 4/2001 | Wenger et al. | D24/133 |
| 6,272,716 | B1 | 8/2001 | Thornton | |
| D470,283 | S | 2/2003 | Vosbikian | |
| 6,584,638 | B2 * | 7/2003 | Nigh et al. | 15/209.1 |
| 6,689,224 | B1 * | 2/2004 | Hillman | 134/6 |
| D502,002 | S * | 2/2005 | Conway et al. | D4/138 |
| 7,249,392 | B1 | 7/2007 | Paille | |
| 8,122,558 | B1 | 2/2012 | Gary et al. | |
| 8,151,400 | B2 | 4/2012 | McCoy | |
| D679,003 | S * | 3/2013 | Jupin | D24/119 |
| 2004/0237239 | A1 | 12/2004 | Savell | |
| 2008/0258002 | A1 | 10/2008 | Migliaccio | |

FOREIGN PATENT DOCUMENTS

WO WO 03/009733 A1 * 2/2003

* cited by examiner

*Primary Examiner* — Randall Chin

(57) ABSTRACT

A hygienic wiping device facilitates removal of fecal matter from a user's anal region after defecation. The device includes a handle having a first end, a second end and a perimeter surface extending between the first and second ends of the handle. A head is coupled to the handle and is configured to receive a wiping element thereon. An outwardly projecting lip is coupled to the head. The lip is configured to retain the wiping element on the head.

12 Claims, 3 Drawing Sheets

HYGIENIC WIPING DEVICE

BACKGROUND OF THE DISCLOSURE

Field of the Disclosure

The disclosure relates to sanitary wiping devices and more particularly pertains to a new sanitary wiping device for facilitating removal of fecal matter from a user's anal region after defecation.

SUMMARY OF THE DISCLOSURE

An embodiment of the disclosure meets the needs presented above by generally comprising a handle having a first end, a second end and a perimeter surface extending between the first and second ends of the handle. A head is coupled to the handle and is configured to receive a wiping element thereon. An outwardly projecting lip is coupled to the head. The lip is configured to retain the wiping element on the head.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
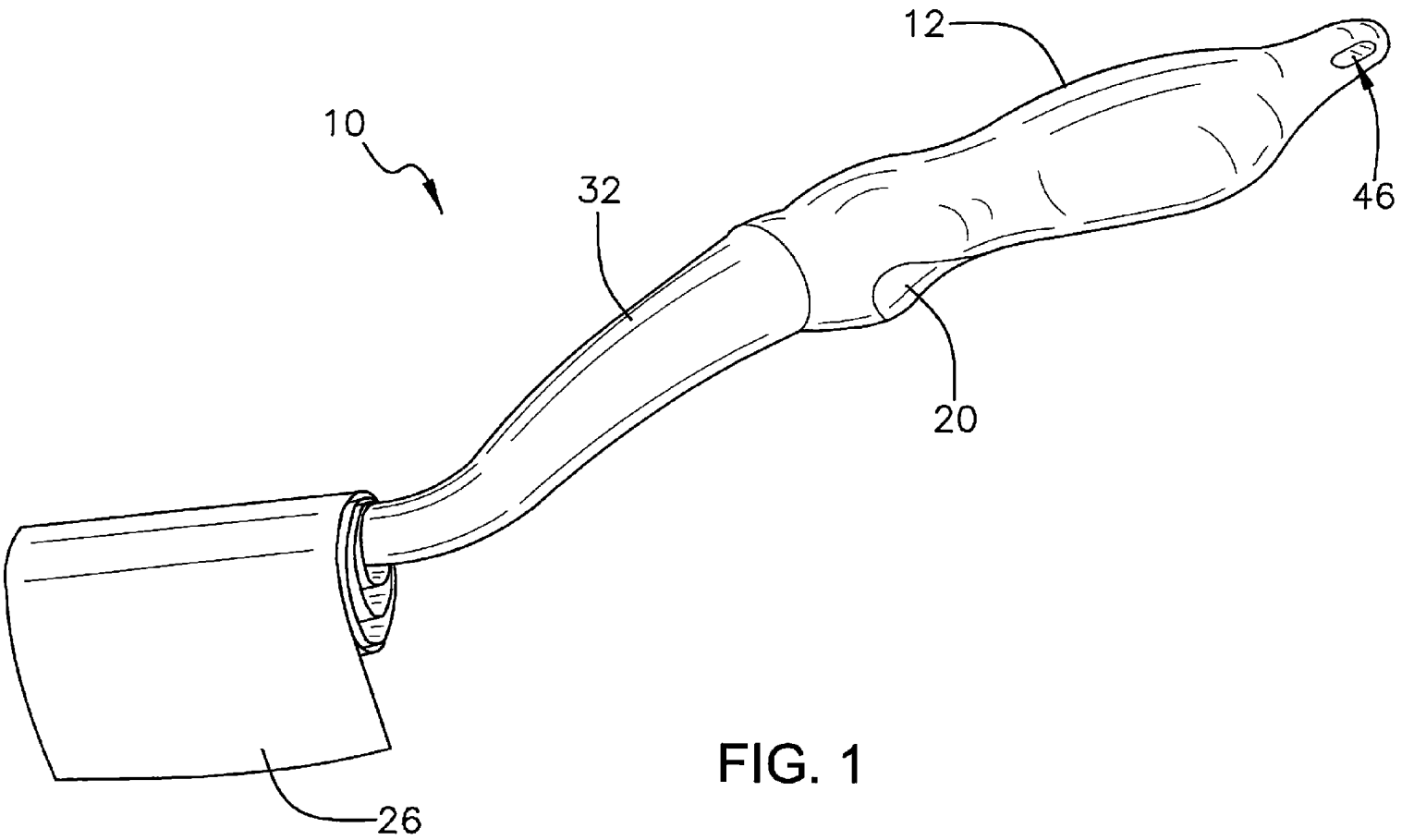
FIG. 1 is a perspective view of a hygienic wiping device according to an embodiment of the disclosure.
Figure 2:
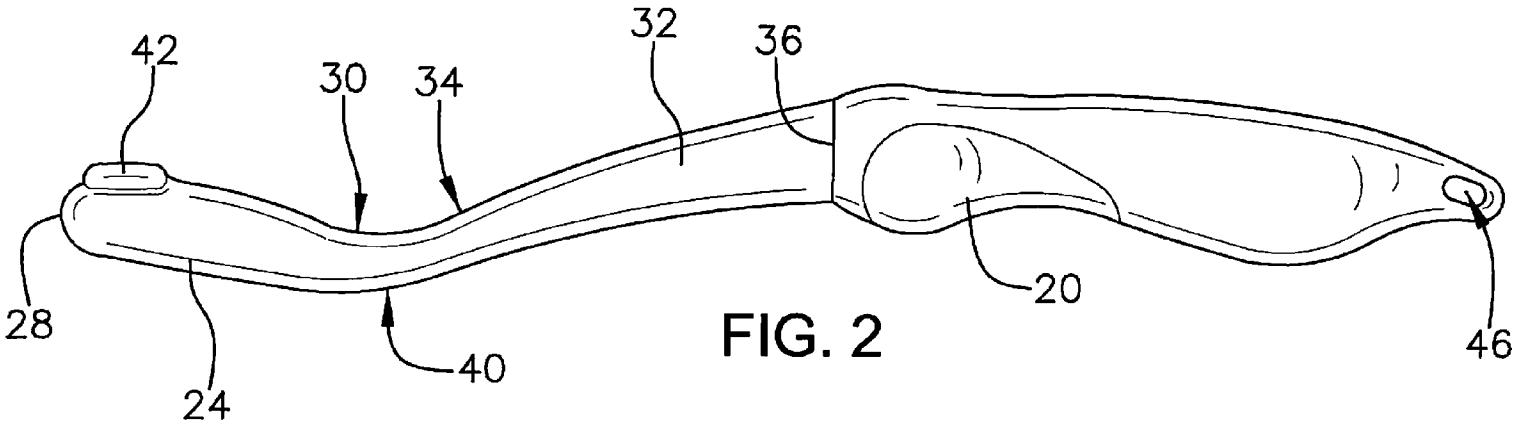
FIG. 2 is a side view of an embodiment of the disclosure.
Figure 3:
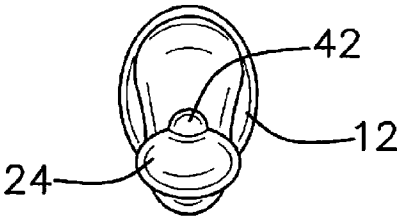
FIG. 3 is a front view of an embodiment of the disclosure.
Figure 4:
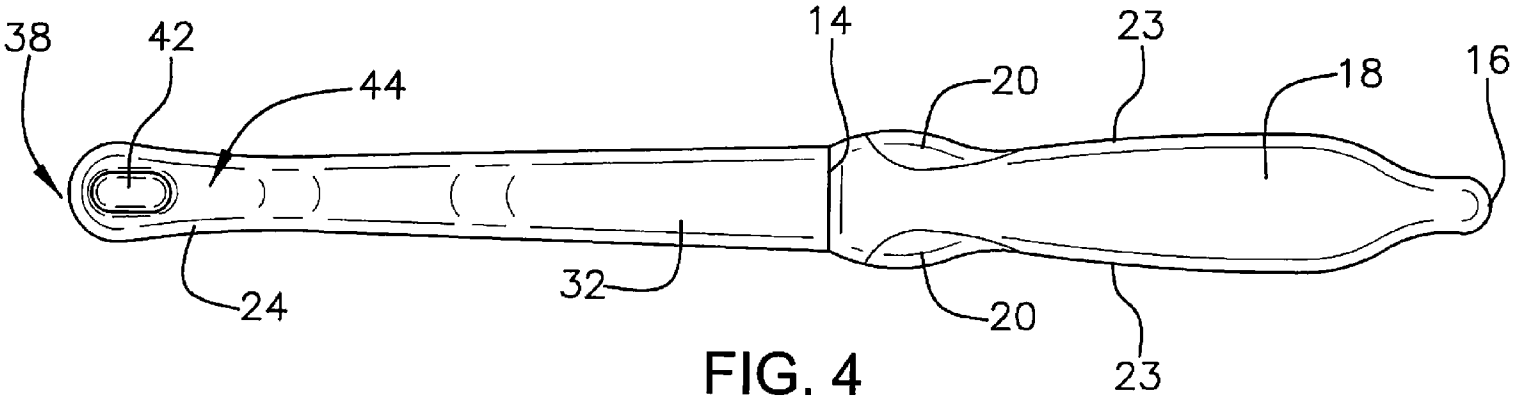
FIG. 4 is a top view of an embodiment of the disclosure.
Figure 5:
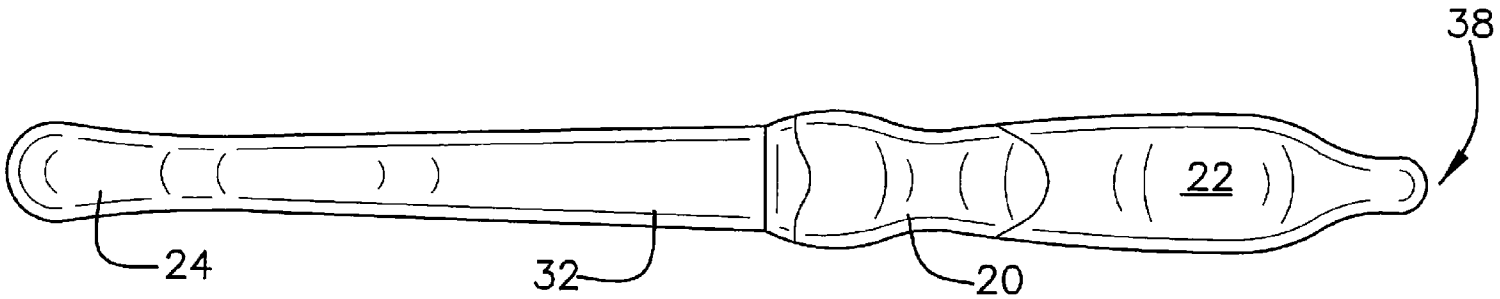
FIG. 5 is a bottom view of an embodiment of the disclosure.

With reference now to the drawings, and in particular to FIGS. 1 through 5 thereof, a new sanitary wiping device embodying the principles and concepts of an embodiment of the disclosure and generally designated by the reference numeral 10 will be described.

As best illustrated in FIGS. 1 through 5, the hygienic wiping device 10 generally comprises a handle 12 having a first end 14, a second end 16 and a perimeter surface 18 extending between the first 14 and second 16 ends of the handle 12. The perimeter surface 18 may generally form a cylindrical shape which may include areas of different diameters. A grip 20 is positioned on the handle 12 to facilitate grasping of the handle 12. The grip 20 may be positioned proximate the first end 14 of the handle 12. In particular, the grip 20 extends across a bottom surface 22 of the handle 12 and upwardly toward lateral sides 23 of the handle 12.

A head 24 is coupled to the handle 12. The head 24 is configured to receive a wiping element 26 thereon. The wiping element 26 may include rolled sheets of toilet paper or the like. The head 24 has a first end 28 and a second end 30. The first end 28 of the head 24 may be convexly arcuate. In addition, the head 24 may taper outwardly from the second end 30 of the head 24 toward the first end 28 of the head 24.

A neck 32 is coupled to and extends between the head 24 and the handle 12. The neck 32 has a first end 34 and a second end 36. The first end 34 of the neck 32 is coupled to the second end 30 of the head 24. The second end 36 of the neck 32 is coupled to the first end 14 of the handle 12. The neck 32 may taper outwardly from the first end 34 of the neck 32 toward the second end 36 of the neck 32. The neck 32 is angled downwardly relative to the first end 14 of the handle 12. The head 24 is angled upwardly relative to the first end 34 of the neck 32. The head 24, the neck 32 and the handle 12 define an elongated member 38. A juncture 40 of the head 24 and the neck 32 may be arcuate.

An outwardly projecting lip 42 is coupled to the head 24. The lip 42 is configured to retain the wiping element 26 on the head 24. The lip 42 is positioned on a top surface 44 of the head 24 and may be positioned proximate the first end 28 of the head. A longitudinal axis extends through the lip 42 and is positioned parallel relative to a longitudinal axis extending through the head 24. The lip 42 may be oval-shaped.

A hole 46 is positioned in the handle 12 and may be positioned proximate the second end 16 of the handle 12. The hole 46 is configured for receiving a mounting member therethrough wherein the hole 46 facilitates hanging of the elongated member 38. For instance, the device 10 may be hung on a hook or similar structure by inserting the hook through the hole 46.

The device 10 is constructed from lightweight materials, such as plastic or the like. The device 10 may have a total length between approximately 22.0 centimeters and 36.0 centimeters. The handle 12 may have a length between approximately 10.0 centimeters and 18.0 centimeters and a width between approximately 1.3 centimeters and 6.4 centimeters.

In use, as stated above and shown in the Figures, the wiping element 26 is positioned on the head 24. The wiping element 26 may include approximately six sheets of toilet paper that are attached together and wrapped around the head 24, as shown in FIG. 1. The wiping element 26 is then wetted with water. The user grasps the handle 12 and maneuvers the elongated member 38 so that wiping element 26 contacts and helps remove fecal matter from the user's anal region after defecation. The used wiping element 26 is then removed and replaced with a new and unused wiping element 26. The wiping element 26 is again wetted and the process repeated until the user's anal region is sanitary. The lip 42 helps to retain the wiping element 26 on the head 24 while the device 10 is being used. The device 10 is particularly useful for users who are overweight, pregnant or have back problems.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A hygienic wiping device comprising:

a handle having a first end, a second end and a perimeter surface extending between said first and second ends of said handle;

a head coupled to said handle, said head being configured to receive a wiping element thereon;

a neck being attached to and extending between said head and said handle, a bend being formed at a juncture of said neck and said head, said head and said neck having an upper surface and a lower surface, said bend forming an obtuse angle of less than 180° in a juncture of said upper surfaces of said head and said neck, said head having an arcuate outer surface including said upper surface and said lower surface each being rounded, a cross-section of said head being oval shaped and being elongated along a line positioned between upper and lower surfaces; and an outwardly projecting lip coupled to said head, said lip being configured to retain the wiping element on said head, said lip comprising an upwardly extending nub positioned adjacent to a free end of said head and extending upwardly from said upper surface, said lip being spaced from said lower surface and from a pair of lateral sides of said head, said lip being elongated along a line extending between said free end and said bend, said lip having a convexly arcuate outer surface.

2. The device of claim 1, further comprising a grip positioned on said handle to facilitate grasping of said handle.

3. The device of claim 2, further comprising said grip extending across a bottom surface of said handle and upwardly toward lateral sides of said handle.

4. The device of claim 1, further comprising said head having a first end and a second end, said first end of said head being positioned distally relative to said handle, said head tapering outwardly from said second end of said head toward said first end of said head.

5. The device of claim 1, wherein said neck has a first end and a second end, said first end of said neck being coupled to a second end of said head, said second end of said neck being coupled to said first end of said handle.

6. The device of claim 5, further comprising said neck tapering outwardly from said first end of said neck toward said second end of said neck.

7. The device of claim 5, further comprising said neck being angled downwardly relative to said first end of said handle.

8. The device of claim 5, further comprising said head being angled upwardly relative to said first end of said neck.

9. The device of claim 5, further comprising:

said head, said neck and said handle defining an elongated member; and a hole being positioned in said handle, said hole being configured for receiving a mounting member therethrough wherein said hole facilitates hanging of said elongated member.

10. The device of claim 9, further comprising said hole being positioned proximate said second end of said handle such that said hole is positioned distally relative to said head.

11. The device of claim 5, further comprising a juncture of said head and said neck being arcuate.

12. The device of claim 1, further comprising a longitudinal axis extending through said lip being positioned parallel relative to a longitudinal axis extending through said head.

* * * * *